United States Patent [19]

Bollinger, Jr. et al.

[11] 4,069,464

[45] Jan. 17, 1978

[54] BIMETAL OVERLOAD RELAY

[75] Inventors: Parker A. Bollinger, Jr., Franklin; Norbert F. Frymark, Glendale, both of Wis.

[73] Assignee: Allen-Bradley Company, Milwaukee, Wis.

[21] Appl. No.: 715,681

[22] Filed: Aug. 19, 1976

[51] Int. Cl.[2] ..... H01H 61/02

[52] U.S. Cl. ..... 337/77; 337/78; 337/102

[58] Field of Search ..... 337/53, 59, 77, 78, 337/85, 89, 101, 102, 333, 343, 345, 347, 349, 360, 361

[56] References Cited

U.S. PATENT DOCUMENTS

| | | | |
|---|---|---|---|
| 3,213,243 | 10/1965 | Anderson et al. | 337/102 X |
| 3,238,335 | 3/1966 | Randolph et al. | 337/102 X |
| 3,251,966 | 5/1966 | Kussy et al. | 337/53 X |
| 3,265,831 | 8/1966 | Ramsey et al. | 337/78 X |
| 3,423,712 | 1/1969 | Howard | 337/77 |

*Primary Examiner*—A. D. Pellinen
*Attorney, Agent, or Firm*—Barry E. Sammons

[57] ABSTRACT

A U-shaped heater unit is surrounded by a U-shaped bimetal, the legs of which move in response to temperature variations. The motion of the bimetal is conveyed through a wall by a slidable pin which acts to rotate an L-shaped compensator element. This rotation lifts a link element which operates a switch when the trip point is reached. A reset mechanism includes a plunger which when manually depressed rotates a reset arm first in one direction to reset the switch after it has been tripped and then in the opposite direction to a neutral station in which it will not reset the switch. The reset mechanism thus cannot be defeated by jamming the plunger in its fully depressed position.

3 Claims, 6 Drawing Figures

Fig.3
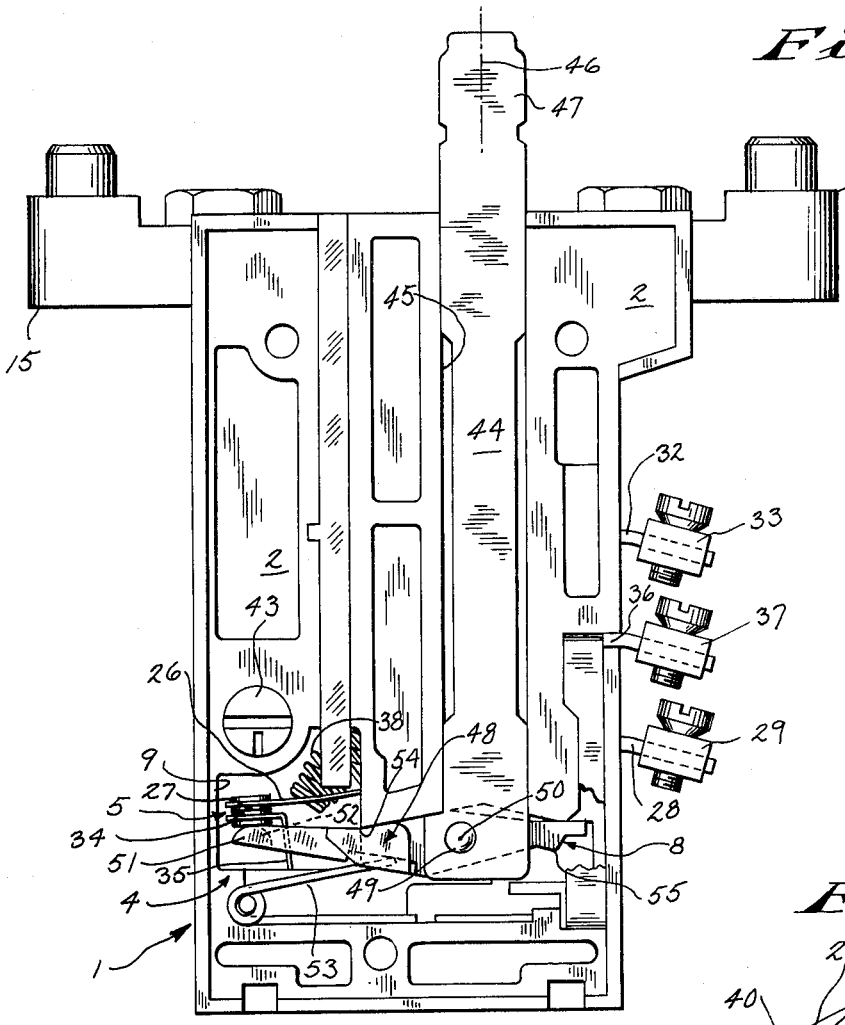
Fig.6
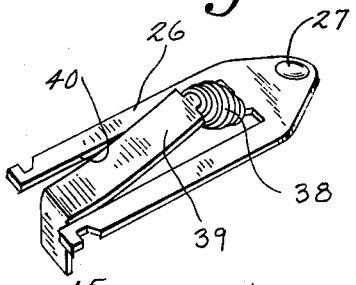
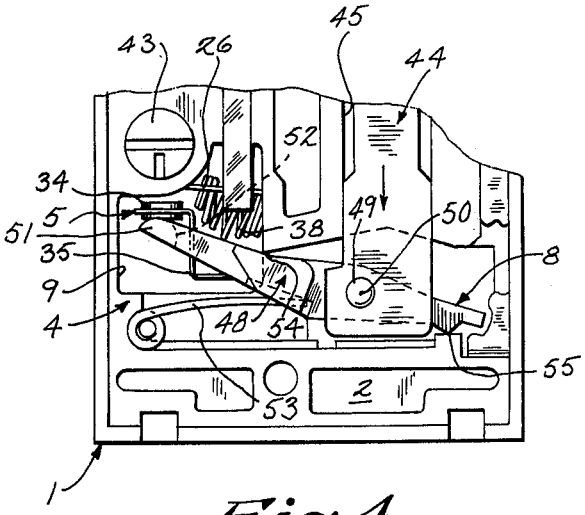
Fig.4
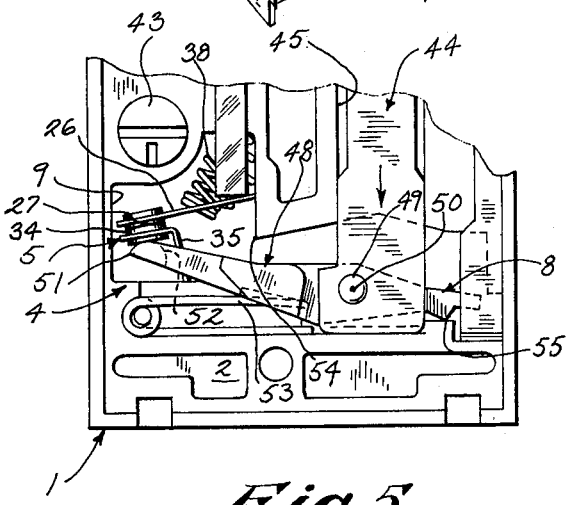
Fig.5

BIMETAL OVERLOAD RELAY

BACKGROUND OF THE INVENTION

The field of the invention is overload relays, and particularly, bimetal overload relays such as that disclosed in U.S. Pat. Nos. 3,267,236 and 3,852,694.

Bimetal overload relays include a snap action electrical switch which has a contact that is movable between an unactuated and an actuated position to make or break electrical connection with a stationary contact. This movable contact is mechanically coupled to a main bimetal element that is responsive to changes in temperature to operate the electrical switch. A heater unit is disposed adjacent to the main bimetal element and is connected in circuit with the device to be protected from current overloads. As the current flowing in this circuit rises, the temperature of the heater unit increases causing the main bimetal to change shape. When a predetermined current level is reached, the electrical switch is mechanically actuated, or tripped, by this motion of the bimetal element.

Such bimetal relays are of two general types with respect to the manner in which they are reset after being tripped by a current overload condition. In some, the snap action switch is biased so that as soon as the bimetal element cools, the switch returns to its unactuated position automatically. Other bimetal relays, however, have a manual resetting action in which a button, or plunger, must be operated to reset the snap action switch to its unactuated position. In installations where manually resettable type bimetal relays are employed, it is important that the reset mechanism not be easily defeatable by jamming the button or plunger in a depressed position so that the switch is automatically reset when the bimetal cools.

SUMMARY OF THE INVENTION

The present invention relates to a bimetal overload relay, and particularly, to an improved means for actuating the snap action switch in response to the motion of the bimetal element. The invention further resides an improved reset mechanism for such a bimetal overload relay in which the manual reset mode cannot easily be defeated by holding the plunger in its fully depressed position.

The invented relay includes a case which defines a first compartment that houses a heating element and a main bimetal element, and a second compartment that houses a snap action switch. The motion of the main bimetal element is coupled to the switch by coupling means which includes a pin mounted for sliding motion in an opening which communicates with the first and second compartments, a compensator element mounted within the second compartment for rotation about an axis and having a first leg which extends radially outward from the axis to engage one end of the pin and a second compensating bimetal leg which extends radially outward from the axis and is coupled to the snap action switch by a link.

The reset mechanism includes a plunger which extends into the case and rotatably connects to a reset arm that pivots about a first point to reset the snap action switch when the plunger is depressed from an unactuated to an actuated position, and that pivots in the opposite direction about a second pivot point to a neutral station when the plunger is depressed further to an over-actuated position. In the neutral station the reset arm will not reset the snap action switch, and as a result, the reset mechanism cannot be defeated by jamming, or holding, the plunger in its fully depressed, or over-actuated position.

A general object of the invention is to provide a bimetal overload relay with an accurate trip point. The compensating bimetal leg on the compensating element is responsive to compensate the main bimetal element for changes in ambient temperature. A more accurate indication of the ambient temperature is obtained by locating the compensating element in a compartment which is separate from the heating element. As a result, the snap action switch is more accurately tripped at a predetermined current flow.

Another general object of the invention is to prevent the manual reset mechanism from being easily defeated. As the plunger is depressed from its unactuated position, the reset arm pivots first in one direction until an operating surface on one of its ends swings into engagement with and resets the snap action switch. As the plunger is depressed further, however, the reset arm pivots in the opposite direction and its operating surface is quickly swung to a position which will not reset the snap action switch. Thus, the reset mechanism can be defeated only by jamming, or holding, the plunger at a proper point which is intermediate its mechanical limits of motion and which is difficult to detect.

The foregoing and other objects and advantages of the invention will appear from the following description. In the description reference is made to the accompanying drawings which form a part hereof, and in which there is shown by way of illustration a preferred embodiment of the invention. Such embodiment does not necessarily represent the full scope of the invention, however, and reference is made, therefore, to the claims herein for interpreting the scope of the invention.

BRIEF DESCRIPTION OF THE DRAWINGS

FIG. 3 is a back elevation view of the bimetal overload relay of FIG. 1 with the back wall cut away to show the reset mechanism elements in their unactuated position, FIG. 4 is a partial view as in FIG. 3 showing the reset mechanism elements in their actuated position, FIG. 5 is a partial view as in FIG. 3 showing the reset mechanism elements in their over-actuated position, and FIG. 6 is a perspective view of the contact carrying arm and toggle spring which form part of the snap action switch.

DESCRIPTION OF THE PREFERRED EMBODIMENT

Figure 2:
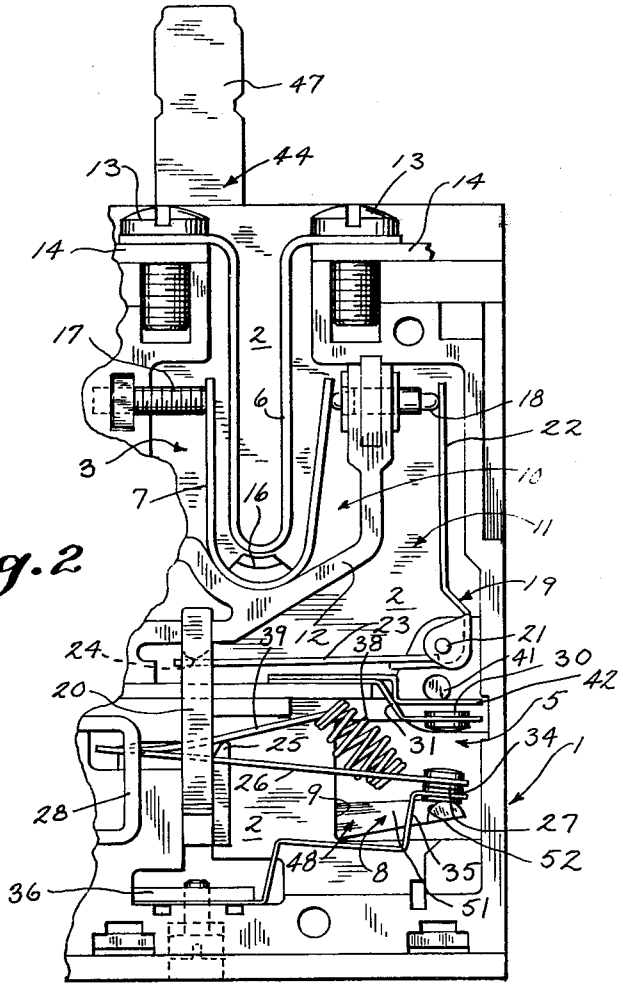
FIG. 2 is a partial view as in FIG. 1 showing the elements of the bimetal overload relay in their tripped position.

The bimetal overload relay is enclosed in a molded plastic insulating housing which is comprised of a substantially rectangular-shaped case 1 and front and rear covers (not shown in the drawings). The case 1 is molded as a single piece and includes an integrally molded web 2 which extends across the interior of the housing to divide it into a front enclosed space 3 viewed in FIG. 1 and a rear enclosed space 4 viewed in FIG. 3. As will be described in more detail below, the elements of an electrical switch 5, heater unit 6, main bimetal 7 and elements which couple them together are mounted in the front enclosed space 3; whereas the elements of a reset mechanism 8 are mounted in the rear enclosed space 4. The two enclosed spaces 3 and 4 communicate through a substantially rectangular window 9 which is formed in the web 2.

Figure 1:
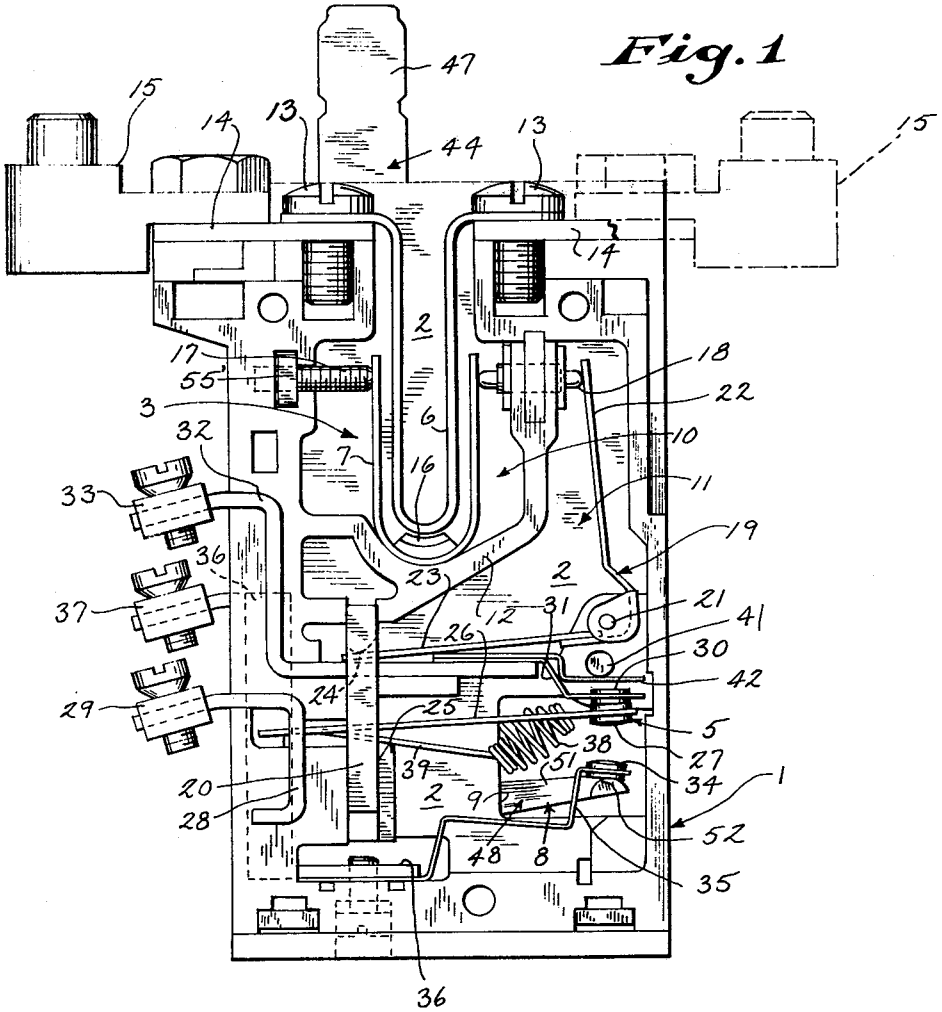
FIG. 1 is a front elevation view with cover removed of the invented bimetal overload relay showing the elements thereof in their untripped position.

Referring particularly to FIG. 1, the front enclosed space 3 is further divided into a first compartment 10, and a second compartment 11 by an integrally molded wall 12. The U-shaped heater unit 6 is disposed within the first compartment 10 and is held in place by a pair of terminal screws 13 which extend downward therethrough into threaded openings formed in metallic buses 14. The buses 14 are anchored to the case 1 and extend laterally outward and mount a wire terminal 15 at their end. The heater unit 6, buses 14 and wire terminals 15 form an electrically conductive path which is connected in circuit with the device to be protected from current overloads. As is well known in the art, the heater unit 6 is available in various configurations, sizes and ratings.

Also enclosed within the first compartment 10 is the main bimetal 7. The main bimetal 7 has a U shape and it is disposed around the lower end of the heater unit 6 and held in place against the wall 12 by an ear 16 which is integrally formed to the web 2. A calibrating screw 17 is received by a threaded nut 55' which is retained in an opening formed in the case 1 and it extends into the first compartment 10 and into contact with one leg of the U-shaped main bimetal 7. A pin 18 is slidably mounted within an opening through the wall 12 and one end of the pin is held in contact with the other leg of the U-shaped bimetal 7 by coupling elements which are mounted within the second compartment 11.

As the temperature rises in the first compartment 10 due to current flowing through the heater unit 6, the legs on the U-shaped main bimetal 7 spread apart, or separate. The calibrating screw 17 maintains the one leg of the bimetal 7 stationary, and as a result, the spreading results in the sideways translation of its other leg against the pin 18 causing it to translate to the right as viewed in FIG. 1. By adjusting the calibrating screw 17, the absolute position of the bimetal 7 and the pin 18 can be altered to calibrate the trip point of the bimetal overload relay.

The translational motion of the pin 18 is coupled to the electrical switch 5 by an L-shaped compensator element 19 and a link element 20. The compensator element 19 is mounted in the second compartment 11 for rotation about an axis 21, and it includes a first leg 22 which extends radially outward from the axis 21 and into engagement with the end of the pin 18. The compensator element 19 also includes a second leg 23 which extends radially outward from the axis 21 at substantially a right angle from the first leg 22. The second leg 23 is formed from a bimetal which bends downward, or away from, the first leg 22 when the temperature within the second compartment 11 rises. The location of the bimetal leg 23 in a separate compartment from the heater unit 6 insulates it from the heat generated by the heater unit 6.

Translational motion of the pin 18 rotates the L-shaped compensator element 19 about its axis 21 and swings the end of its bimetal leg 23 through a vertically directed arc. The link element 20 is mounted to the case 1 for sliding motion along a vertical axis and it includes an integrally molded bearing member 24 which is formed on its upper end. The bearing member 24 "hooks" the end of the bimetal leg 23, and as the compensator element 19 rotates clockwise in response to increased current flow through the heater unit 6, the link element 20 is lifted upward. An actuator member 25 is formed on the lower end of the link element 20 to engage and operate the electrical switch 5 when the trip point is reached.

Electrical switch 5 includes a bifurcated metallic contact carrying arm 26 which is pivotally fixed at one end to a bus 28 and which supports a movable contact 27 at its free end. The contact carrying arm 26 is received in a window which is formed in the bus 28, and the bus 28 extends through an opening in the case 1 and is terminated with a wire terminal 29. A first stationary contact 30 is disposed above the movable contact 27 and is supported on the end of a metallic arm 31. The arm 31 is in turn fastened to a bus 32 which extends across the interior of the case 1 and through an opening therein formed along its left hand side. The bus 32 supports a wire terminal 33 at its exposed end. A second stationary contact 34 is disposed beneath the movable contact 27 and is mounted on the end of a second metallic arm 35. The arm 35 fastens to a bus 36 which winds through the case 1 and out an opening on the left hand side where it terminates with a wire terminal 37.

The electrical switch 5 is operated by the translational motion of the link element 20 which engages an actuator blade 39. The actuator blade 39 is fastened to the bus 28 by rivets (not shown), and as shown best in FIG. 6, the actuator blade 39 is disposed to swing through a central opening 40 formed in the arm 26 to either side of the plane which it defines. A toggle spring 38 provides a bias force which urges the actuator blade 39 out of the plane of the contact carrying arm 26 to either side thereof. In response to the movement of the actuator blade 39 by the link element 20, the contact carrying arm 26 swings between an unactuated position in which the movable contact 27 engages the first stationary contact 30, and an actuated, or tripped, position in which it engages the second stationary contact 34. The contact carrying arm 26 is biased into engagement with the stationary contact 30 or 34 by the toggle spring 38.

The electrical switch 5 operates between its unactuated position shown in FIG. 1, and its actuated, or tripped, position shown in FIG. 2 in response to temperature changes within the first compartment 10. With increased temperature in the compartment 10 due to current flowing in the heater unit 6, the legs of the U-shaped main bimetal 7 separate to translate the pin 18 outward, or to the right as viewed in FIGS. 1 and 2. This motion in turn causes the L-shaped compensator element to rotate clockwise about the axis 21 and to thus lift the link element 20 upward. The actuator member 25 on the link element 20 engages the underside of the actuator blade 39 and forces it toward the plane of the contact carrying arm 26 against the force of the toggle spring 38. When the actuator blade 39 passes through the plane of the contact carrying arm 26, it snaps quickly to the actuated position shown in FIG. 2 with the result that the movable contact 27 is swung quickly downward into contact with the second stationary contact 34. Electrical switch 5 remains in this tripped position until it is manually reset by the mechanism to be described below.

The gap, or separation, between the stationary contacts 30 and 34 of the electrical switch 5 can be manually adjusted by rotating an eccentric cam 41. As shown best in FIGS. 1-3, the cam 41 is a molded plastic element which extends through an opening in the case 1 and which is disposed adjacent the first stationary contact 30. It engages a gap adjustment blade 42 that attaches to the metallic arm 31, and when it is rotated, its eccentric surface moves the blade 42. Movement of the gap adjustment blade 42 causes the first stationary contact 30 to swing towards or away from the second stationary contact 34 to vary the distance, or gap, therebetween. As seen best in FIG. 3, the eccentric cam 41 includes a slotted head 43 which is accessible from the rear enclosed space 4 of the case 1. By inserting a screwdriver blade into the slot of the head 43, the eccentric cam 41 can be easily rotated to adjust the gap between the stationary contacts 30 and 34.

Referring particularly to FIGS. 3-5, the reset mechanism 8 is comprised of a set of elements which are disposed within the rear enclosed space 4. The reset mechanism 8 includes a plunger 44 which is received in a guideway 45 that is molded into the case 1. The plunger 44 is free to slide along an actuation axis 46 and its upper end 47 extends through the top of the case 1 where it is easily accessible. The lower end of the plunger 44 is rotatably connected to a reset arm 48 by a pin 49. The reset arm 48 is disposed within the rear enclosed space 4 and it pivots about an axis 50 between an unactuated position shown in FIG. 3, an actuated position shown in FIG. 4, and a neutral station, or over-actuated position, shown in FIG. 5. The reset arm 48 includes an operating portion 51 which extends toward the window 9 formed in the web 2 and a curved bearing surface 52 is formed on the end of the reset arm 48 to extend through the window 9 and into engagement with the underside of the second stationary contact 34. A bias spring 53 is disposed beneath the reset arm 48 and it engages the underside thereof to urge it and the attached plunger 44 upward to the unactuated position shown in FIG. 3.

When the plunger 44 is depressed, the reset arm 48 is caused to pivot about the axis 50 first in one direction until it reaches the actuated position shown in FIG. 4, and then in the opposite direction until it reaches the overactuated position shown in FIG. 5. During the first portion of the plunger stroke, the operating portion 51 of the arm 48 engages and pivots about a first pivot point 54 formed on the case 1 immediately above the reset arm 48. Further downward movement of the plunger 44, however, causes a second pivot point 55 to be established between the other end of the reset arm 48 and the bottom of the case 1. This second pivot point 55 causes the reset arm 48 to pivot in the opposite direction until the plunger 44 bottoms out.

The second stationary contact 34 on the electrical switch 5 is lifted upward from its normal position by the reset arm 48 during the first portion of the plunger stroke. The contact 34 engages the movable contact 27 and lifts it upward to force the actuator blade 39 downward through the plane of the contact carrying arm 26. If the main bimetal 7 has cooled sufficiently the movable contact 27 snaps to its unactuated position; however, if it has not cooled, the movable contact 27 remains in engagement with the second stationary contact 34 and follows the reset arm 48 back to its tripped position as the second portion of the plunger stroke is commenced. The reset arm 48 pivots about the point 55 in the counterclockwise direction during the second portion of the plunger stroke until the plunger 47 bottoms out as shown in FIG. 5. The reset arm 48 is then in a neutral station in which its operating end 51 is depressed to an over-actuated position which is well below the point necessary to reset the switch 5. In its over-actuated position, therefore, the reset arm 48 does not support the movable contact 27 in a position which allows it to reset when the main bimetal 7 cools, and thus, the trip mechanism cannot be defeated by jamming or holding the plunger 44 in its fully depressed position.

We claim:

1. A bimetal overload relay, the combination comprising:

a case made of an insulating material and defining a first compartment and a second compartment separated by a wall;

a heater unit disposed in said first compartment and being electrically connectable to conduct current in a circuit;

a bimetal disposed in said first compartment and being responsive to changes in temperature therein to change shape;

an electrical switch disposed in said second compartment and being electrically connectable to a second circuit and mechanically operable between an unactuated and an actuated state;

a pin slidably received in an opening formed in said wall to communicate with both of said compartments and to engage said bimetal; and coupling means disposed in said second compartment and mounted to said case for rotation about an axis to couple the sliding motion of said pin to said electrical switch and to thereby actuate said electrical switch when said coupling means rotates a preselected amount, and in which said coupling means includes two legs which extend radially outward from said axis to define an angle therebetween and one of said legs is a bimetal which is responsive to temperature, wherein one of said legs engages said pin and the other of said legs is coupled to said electrical switch.

2. The bimetal overload relay as recited in claim 1 in which said coupling means is coupled to said electrical switch by a slidably mounted link element, said link element including a bearing member which engages said other leg of said coupling means and an actuator member which engages said electrical switch, wherein said link element is translated in response to rotation of said coupling means about its axis.

3. The bimetal overload relay as recited in claim 2 in which said electrical switch includes:

a contact carrying arm having a fixed end, a free end which supports a movable contact, and a central opening which extends through the plane defined by the contact carrying arm;

an actuator blade having a fixed end and a free end which is swingable through said central opening to either side of the plane defined by the contact carrying arm; and a toggle spring disposed between said contact carrying arm and the free end of said actuator blade, wherein said actuator member engages said actuator blade and the translational motion of said link element urges the free end of said actuator blade through the plane defined by the contact carrying arm.

* * * * *